US005941314A

United States Patent [19]

Weinmeister et al.

[11] Patent Number: 5,941,314

[45] Date of Patent: Aug. 24, 1999

[54] PORTABLE BATTERY-POWERED SMOKE VENTILATOR FAN AND EMERGENCY LIGHTING ASSEMBLIES

[75] Inventors: Roger E. Weinmeister; Don E. Weinmeister, both of Windsor, Colo.

[73] Assignee: Super Vacuum Manufacturing Company Inc., Loveland, Colo.

[21] Appl. No.: 09/045,596

[22] Filed: Mar. 20, 1998

[51] Int. Cl.[6] ..... A62C 39/00

[52] U.S. Cl. ..... 169/52; 169/48; 169/91

[58] Field of Search ..... 454/338, 341, 454/342; 169/48, 91, 52

[56] References Cited

U.S. PATENT DOCUMENTS

| | | | |
|---|---|---|---|
| 2,884,075 | 4/1959 | Poon | 169/48 |
| 3,128,036 | 4/1964 | McBride | 230/116 |
| 3,393,745 | 7/1968 | Durstewitz | 169/15 |
| 3,420,310 | 1/1969 | Mears et al. | 169/15 |
| 3,424,250 | 1/1969 | Thomae | 169/15 |
| 3,441,086 | 4/1969 | Barnes | 169/15 |
| 3,500,935 | 3/1970 | Wiedorn | 169/15 |
| 3,559,741 | 2/1971 | Levy | 169/15 |
| 3,607,779 | 9/1971 | King et al. | 252/359 |
| 3,780,812 | 12/1973 | Lambert | 169/15 |
| 3,999,612 | 12/1976 | Noguchi | 169/14 |
| 4,427,074 | 1/1984 | Wollin | 169/46 |
| 4,907,654 | 3/1990 | Eberhardt | 169/70 |
| 5,205,711 | 4/1993 | Raczykowski | 169/63 |
| 5,217,408 | 6/1993 | Kaine | 454/338 |
| 5,395,087 | 3/1995 | VanBasten | 169/52 X |

OTHER PUBLICATIONS

"Super Vac, The Ventilation Specialist: Training Manual for Smoke Ventilation", May 1994.

"Tecumseh: The Challenge of Change", Product brochure, May 1, 1996.

"Super Vac Positive Pressure Ventilator: Specifications—18"—718G4, Product brochure, Apr. 1997.

"Super Vac Product Sheet", undated.

*Primary Examiner*—Harold Joyce
*Attorney, Agent, or Firm*—James R. Young

[57] ABSTRACT

A pressure ventilator of a type carried by firefighters and rescue workers to a burning building to provide either positive or negative pressure ventilation is characterized by a modular structure in which one module comprises a fan and electric motor unit mounted together in a frame on wheels with a handle and another module comprises a battery pack, motor controller, circuits, and connectable electric cables mounted together in a carrying case. The ventilator module has a carrying structure for mounting and holding the battery module, and the battery module has enough capacity to drive the fan in the ventilator module for at least twenty minutes without falling below a minimum voltage threshold. The motor controller in the battery module compares actual voltage to the threshold and disconnects the batteries from the motor in the ventilator unit when the actual voltage falls below the threshold. Convenient cable mountings and connectors, parallel circuit connectors, and optional flood light with mountings and mating cable connectors are also provided.

4 Claims, 5 Drawing Sheets

PORTABLE BATTERY-POWERED SMOKE VENTILATOR FAN AND EMERGENCY LIGHTING ASSEMBLIES

BACKGROUND OF THE INVENTION

1. Field of the Invention

This invention is related to emergency fire-fighting equipment and more specifically to portable battery powered smoke evacuation fan and light assemblies.

2. Description of the Prior Art

Use of ventilation in rescue and firefighting operations is a well-recognized and widely used practice to reduce risks of injury or death from dangerous fire gases, smoke, toxic fumes, flashover, and backdraft situations. The object of ventilation is generally to direct fire gases, smoke, and toxic fumes away from trapped victims, rescuers, and firefighting personnel as well as to lower temperatures in burning areas to minimize flashover and backdraft situations. Smoke and hot fire gases kill more people and cause more damage than flames.

Natural ventilation techniques take advantage of available winds and of drafts created by rising hot gases of the fire in combination with strategic openings in the burning building. However, it is often beneficial to augment natural ventilation with mechanical ventilation equipment and methods. Fog streams from a fire hose spray nozzle can move considerable amounts of air, but they have the disadvantages of using large quantities of water for non-attack operations, requiring continuous use of a pump, and can cause additional water damage. Ventilation fans are more versatile and have been powered by gasoline engines, electric motors, air motors, and water motors, all of which have their advantages and disadvantages. For example, a water-powered ventilator fan requires handling and connecting long runs of fire hose, a water reservoir, and pump. An air powered ventilator fan requires an air compressor and long runs of air hose. A gasoline engine powered ventilator fan is self-contained, but is heavy (the engine and fan weighing as much as 95 pounds) making it (i) difficult to lift off fire trucks and carry up and down stairs, (ii) brings a highly flammable fuel into a fire environment, (iii) produces dangerous carbon monoxide which blows into the burning house unless long, cumbersome exhaust tubes are used to conduct exhaust out of the building (which tubes get hot and can ignite fires in carpets, papers, and the like), (iv) not able to run in smoky areas, (v) sometimes suffers from carburetor freeze-up, (vi) is sometimes not reliable starting, and (vii) produces high levels of noise that interferes with voice communications. Electric motor operated fans are clean, but they require an electric generator on a fire truck or set outside the building, since electricity is usually turned off at burning buildings, and long electric cords leading into burning houses can be shock hazards and can become entangled and cause tripping hazards.

SUMMARY OF THE INVENTION

Accordingly, it is an object of the present invention to provide a more versatile, safe, easy to handle, and effective mechanical ventilator fan for use in rescue and fire fighting operations.

A more specific object of this invention is to provide a mechanical ventilator that can be lifted on and off fire trucks and carried up and down steps easily, is self-contained and has no long umbilical cord or exhaust tube, operates in smoke and in both positive and negative pressurization ventilation applications, yet has sufficient power to be effective in ventilating burning buildings for enough time to rescue victims and control commonly encountered building fires, i.e., at least about twenty minutes.

Additional objects, advantages, and novel features of the invention shall be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE PREFERRED EMBODIMENTS

Figure 1:
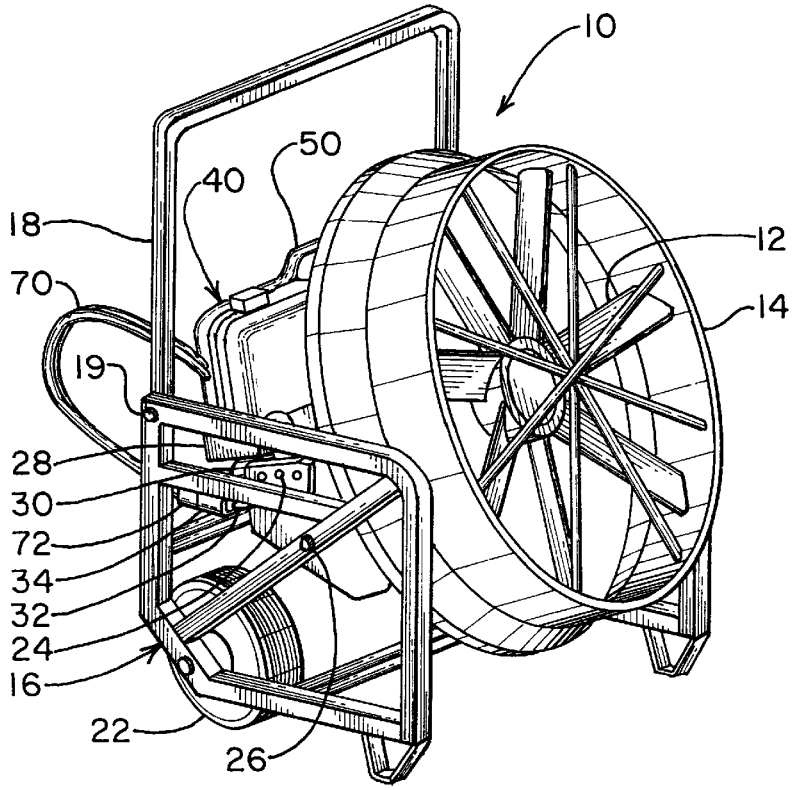
FIG. 1 is a perspective view of the battery-powered smoke ventilation fan assembled with the battery carrying case according to the present invention.

The pressure ventilator of the present invention as shown in FIGS. 1–6 comprises a ventilator unit 10, including a fan 12, electric motor 30, and frame 16, and a battery carrying case 40 containing a battery pack 60, 62, motor controller 64, and appropriate electrical connections, which will be described in more detail below. The ventilator unit 10 is of a type carried by fire fighters and rescue workers to burning buildings to provide either positive or negative pressure ventilation in the burning buildings while rescue workers search for and extricate victims and while fire fighters attack the fire. The ventilator unit 10 and the battery carrying case 40 are outfitted with the respective components described above in order to split the weight of the essential equipment into more conveniently evenly distributed packages. For example, the ventilator unit 10 weighs approximately 40 to 45 pounds, and the battery carrying case 40 outfitted with the components described above and shown in the drawings weighs about 50 pounds. Each of these ventilator unit 10 and battery carry case 40, therefore, can be lifted easily off a fire or rescue vehicle and carried to a burning building, including up or down stairs, by one person, whereas the combined weight of approximately 90 to 95 pounds for both the ventilator 10 and battery carrying case together would be very difficult and cumbersome to handle, especially for one person. Once both the ventilator unit 10 and the battery carrying case 40 are in position at the burning building, the battery pack 60, 62 in the battery carrying case 40 can be connected electrically to the electric motor 30, as will be described in more detail below, to power the electric motor 30 to drive the fan 12.

It is generally understood by rescue and firefighting personnel that pressurization of the interior of a burning building is usually helpful for about twenty minutes after the rescue and firefighting personnel begin their rescue and fire attack work. After about twenty minutes in most burning building situations, the fire is either being brought under control or is damaging the structure of the building enough to make it unsafe for the rescue or fire fighting personnel to remain in the burning building. Therefore, the battery pack 60, 62 of the present invention should have sufficient cells to keep the electric motor 30 powered for at least about twenty minutes. For a ventilator unit 10 with a fan 12 and electric motor 30 large enough to move about 10,000 to 11,000 cubic feet per minute (c.f.m.), about 40 amps steady state is required at about a nominal 24 volts. Two 12-volt, 28.0 amp-hour rated batteries 60, 62 connected together in electrical series, such as to Model PS-12280 sealed rechargeable batteries manufactured by Power Sonic Corporation or two Genesis G12V26Ah10EP battery manufactured by Hawker Energy Products, Inc., of Warrensburg, Mo., are satisfactory for this purpose. The motor 30 can be a Model DCV24-5000 (CCW rol.) four pole, high efficiency, 24-volt D.C. 0.30 horsepower, 2,985 R.P.M. motor with internal ball bearings and aluminum end bells for heat conduction, such as those manufactured by Tecumseh Products Company, Grafton, Wis.

The motor controller 66, also available from Tecumseh Products Company, Grafton, Wis., using solid state components, including MOSFETs for power controllers to regulate the current at about 40 amps and having voltage monitor components to open the electric circuit to the motor 30 when battery voltage falls below a minimum voltage threshold of about 19.25 volts is suitable for purposes of this invention. The minimum voltage threshold shutoff feature is provided in the Tecumseh™ motor controller 66 to protect the batteries from repeated overdischarge, which damages lead-acid batteries.

Figure 2:
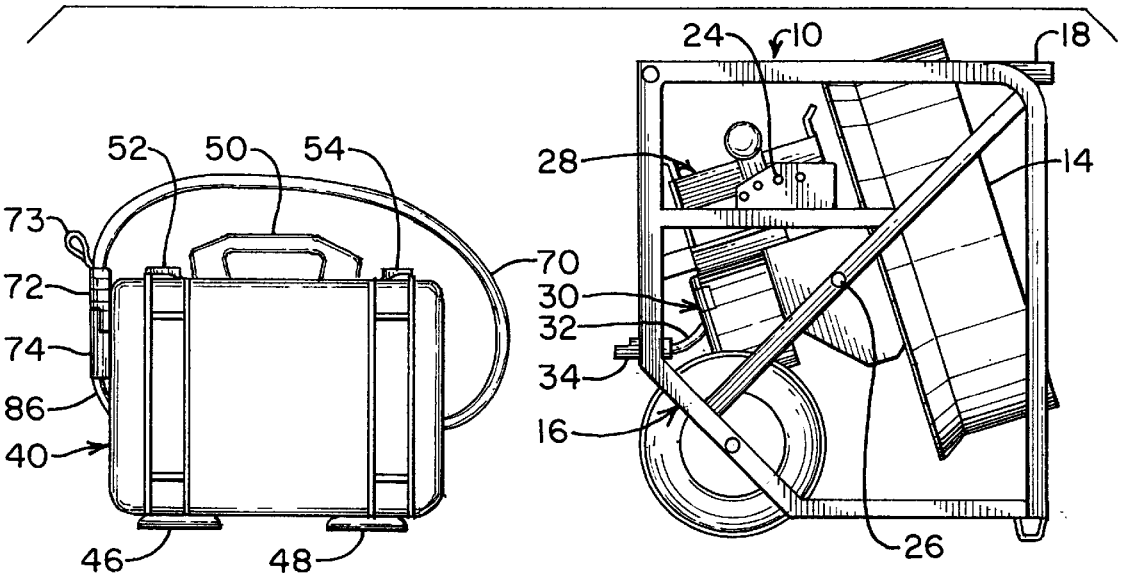
FIG. 2 is a side elevation view of the battery-powered smoke ventilation fan disassembled from the battery carrying case for storage and for convenient carrying to a point of use.
Figure 3:
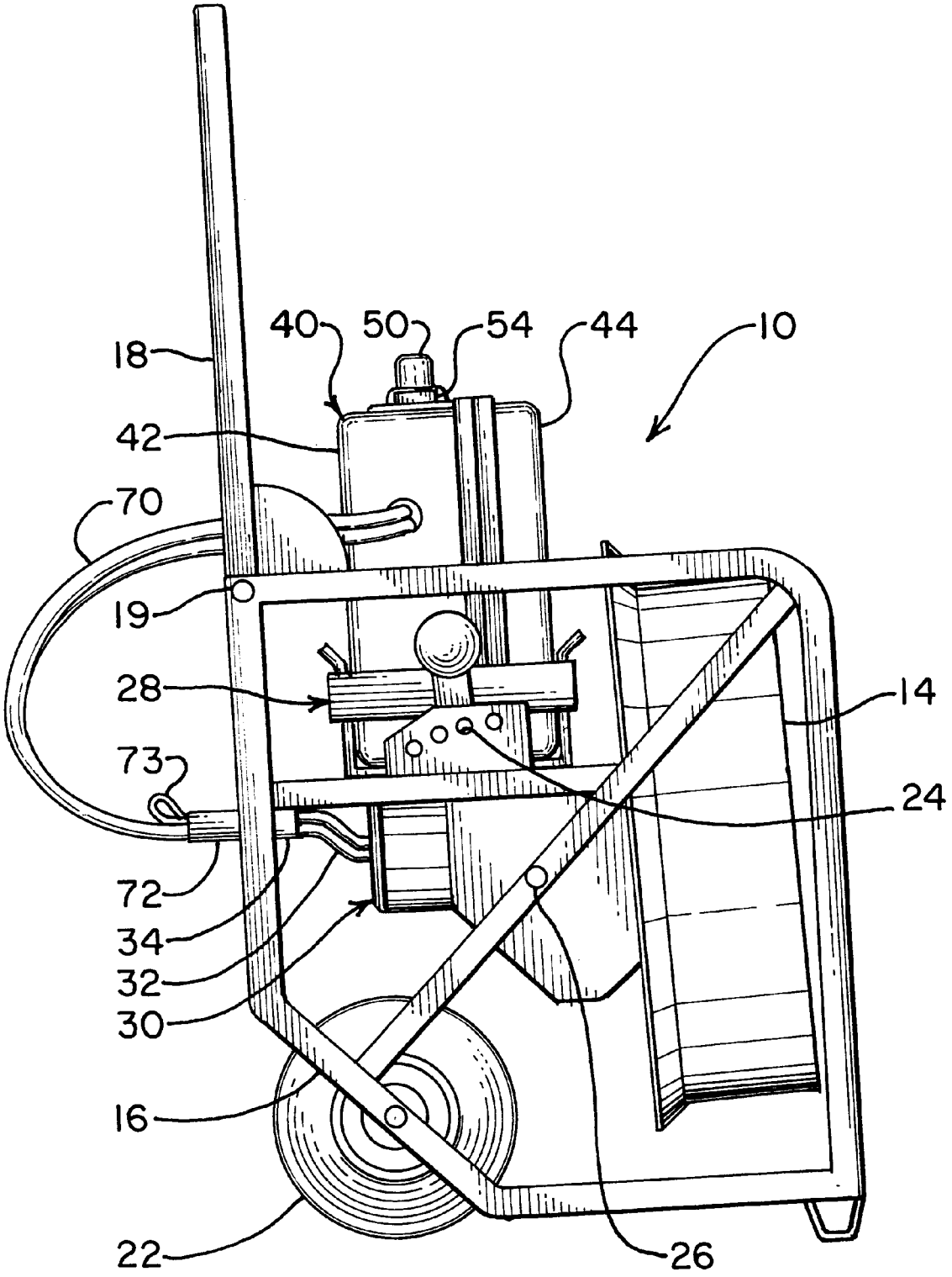
FIG. 3 is a right side elevation view of the battery-powered smoke ventilation fan assembled with the battery carrying case according to the present invention.
Figure 4:
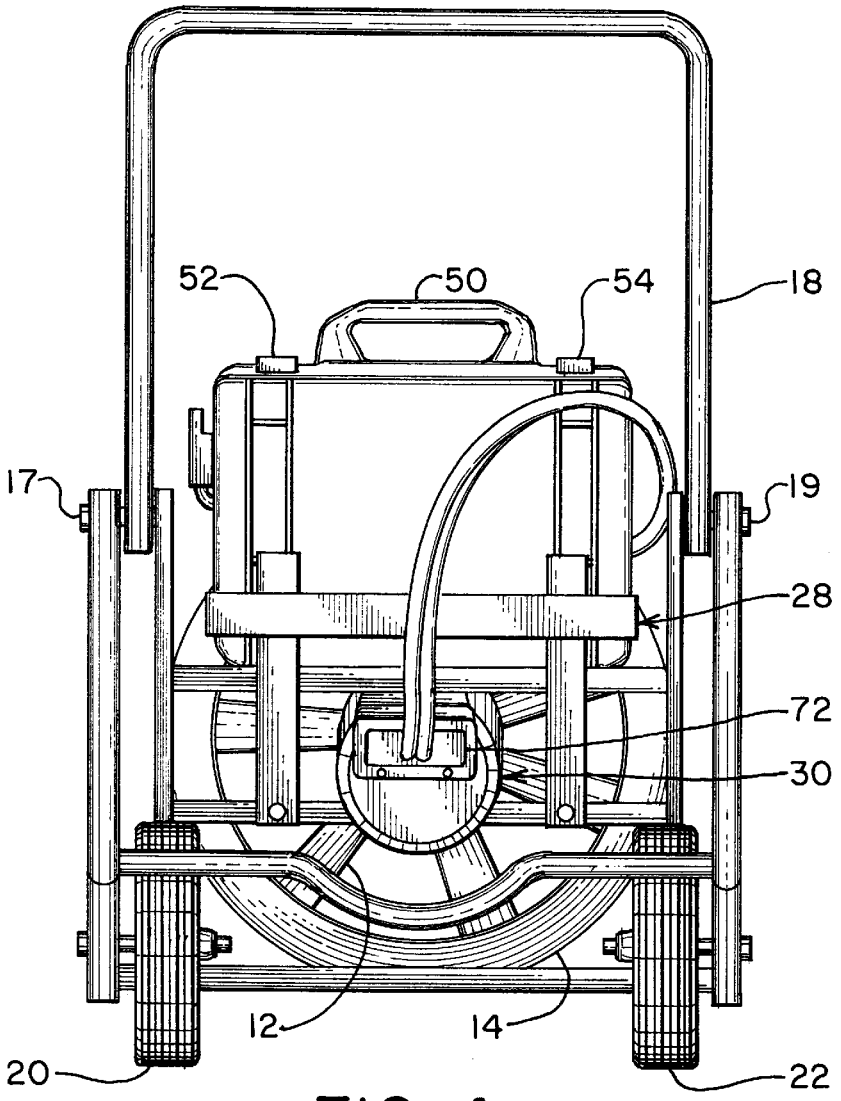
FIG. 4 is a rear elevation view of the battery-powered smoke ventilation fan assembled with the battery carrying case according to the present invention.

The fan 12 is preferably, although not necessarily, mounted on the motor 30 shaft (not shown), as will be understood by persons skilled in the art, and a safety shroud 14 is preferably provided around the fan 12. While not necessary to the invention, the motor 30, fan 12, and shroud 14 can be mounted pivotally on pins 26 in frame 16 with a pivotal adjustment mechanism 24 for setting the fan 12 to blow at any desired angle to horizontal within the range of the adjustment mechanism 24. Wheels 20, 22 are mounted on, and support, the frame 16, and a handle 18 is provided to facilitate moving and maneuvering the ventilator unit 10 on the ground and over floor surfaces. A battery carrying case rack 28 can, but does not have to be, provided on the frame 16 in a size and shape to receive and hold the battery carrying case 40, as shown in FIGS. 1, 3, and 4, which is particularly useful for moving the battery carrying case 40 when the ventilator unit 10 can be moved on its wheels 20, 22 and for setting-up and operating the ventilator unit 10 and battery carrying case 40 as compact unit at the burning building. The handle 18 can be foldable about pivot pins 17, 19 from the upright position shown in FIGS. 1, 3, and 4 to the collapsed position shown in FIG. 2 for stowage.

A first electric cable 32 with two electric conductors extends from electrical connection with the motor 30 to a terminating electric connector receptacle 34, which can be mounted on the frame 16 or positioned in any other convenient manner.

Figure 5:
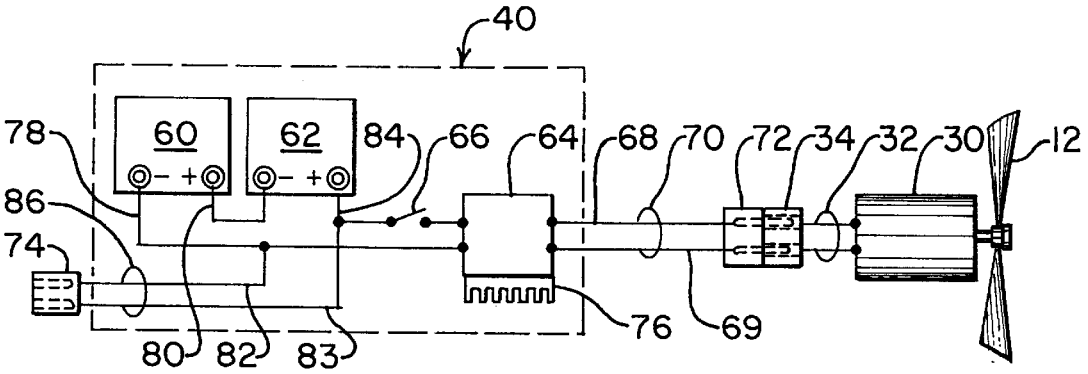
FIG. 5 is a schematic diagram of an electric circuit for connecting the batteries in the battery case to the battery-powered smoke ventilator fan motor according to this invention.
Figure 6:
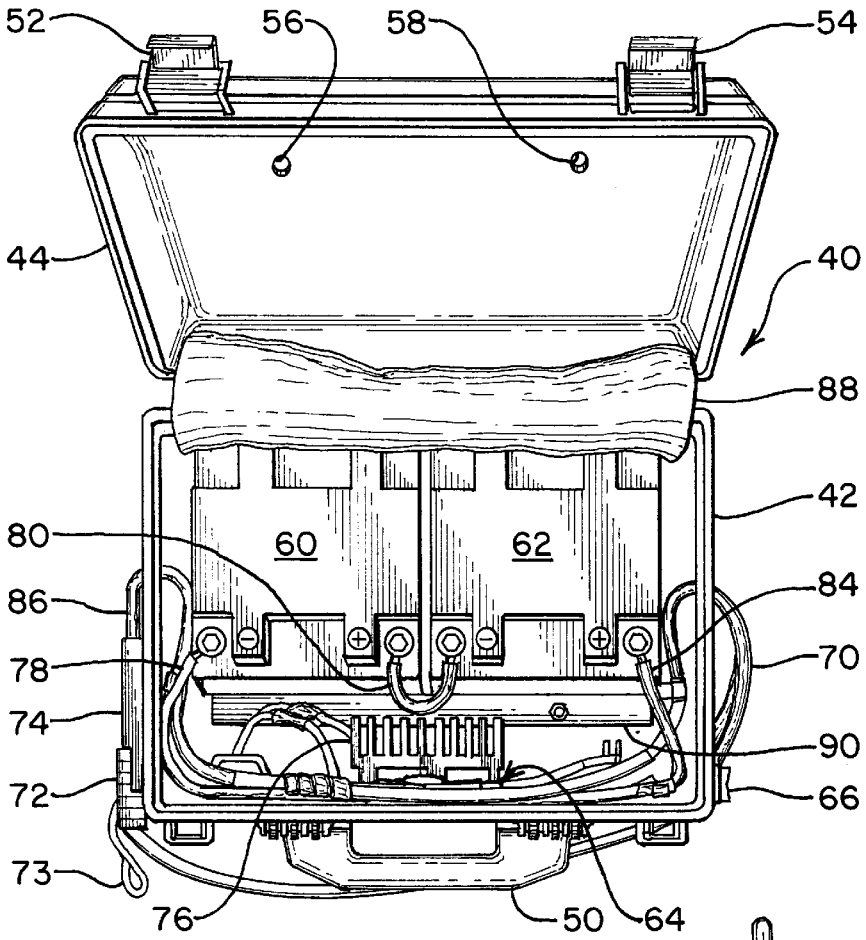
FIG. 6 is a perspective view of the battery carrying case of the present invention with the top of the case opened and the foam rubber cushion sheet folded back to reveal the batteries packed in the case.

The battery carrying case 40 is best seen in FIG. 6 with reference to FIG. 5 for the rudimentary diagrammatic electrical connections. The battery carrying case 40 has a bottom pan 42 hinged to a top lid 44 to form a chamber that contains the battery pack batteries 60, 62 and the motor controller 64. A foam rubber sheet 88 can be spread over the batteries 60, 62 before the lid 44 is closed to provide a cushion between the lid 44 and the batteries 60, 62. The batteries 60, 62 are secured to the bottom pan 42 by a battery retainer 90. A pair of latches 52, 54 on the lid 44 are used to secure the lid 44 to the bottom pan 42 when the lid 44 is closed, as best seen in FIGS. 1–4. A pair of feet 46, 48 as shown in FIG. 2 facilitate supporting the battery carrying case in a stable, upright orientation. A handle 50 is provided for convenient grasping by a rescue worker or firefighters for lifting and carrying the battery carrying case 40.

Returning again to FIGS. 5 and 6, the two 12-volt batteries 60, 62 are connected in electrical series by leads 78, 80, 84 to the 24-volt motor controller 64. A heat sink 76 on the motor controller 64 helps to dissipate heat generated by the electronic components of the flow controller 64, particularly heat generated by the power semiconductors or MOSFETs (not shown). A pair of holes 56, 58 in the lid 44 allow some air circulation through the closed battery carrying case 40 to enhance heat dissipation from the heat sink 76 to the atmosphere.

The motor controller 64 and battery pack 60, 62 in the battery carrying case 40 can be connected to the motor 30 of the ventilator unit 10 with an elongated cable 70 that has two electric conductors 68, 69 and terminates in an electric plug connector 72. The electric connector plug 72 is sized and shaped to mate detachably in electric contact with the electric connector receptacle 34 on the ventilator unit 10, which can be connected and disconnected whenever desired. An on/off switch 66 can be provided in the circuit either before or after the motor controller 64 for turning the electricity from the battery pack 60, 62 to the motor 30 on or off as desired.

Figure 7:
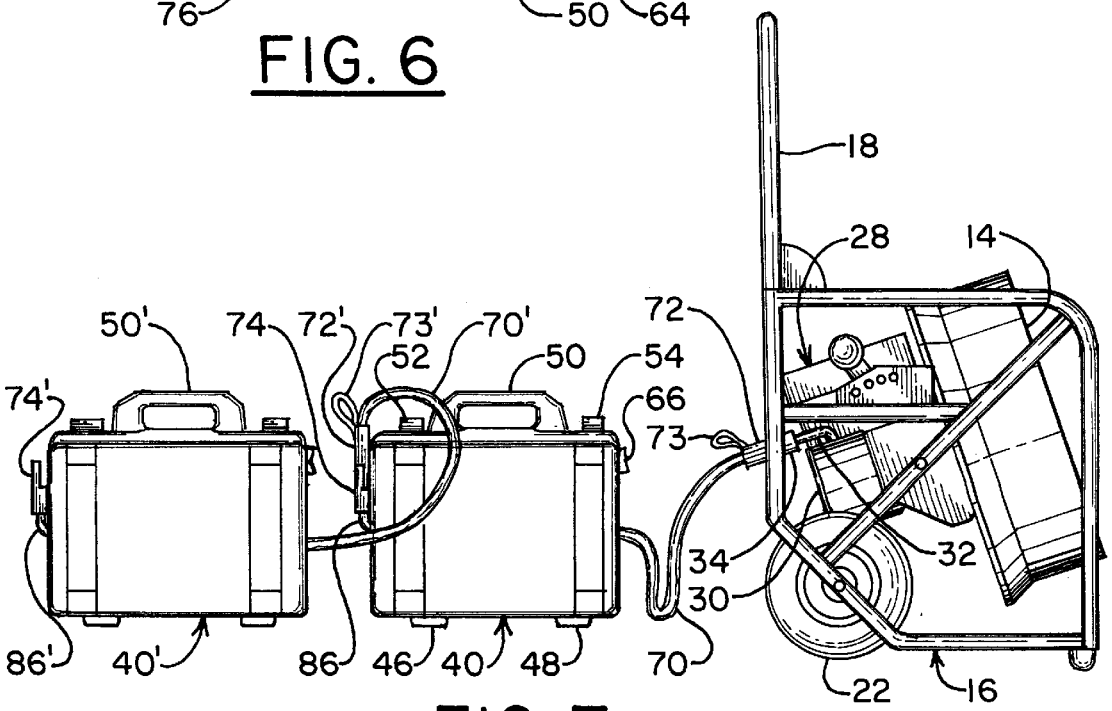
FIG. 7 is a right side elevation view of two battery carrying cases assembled together in parallel electrical connection to the battery-powered smoke ventilation fan of the present invention.

Another feature of this invention, which is illustrated in FIGS. 5, 6, and 7 is a third electric cable 86 with two electric conductors 82, 83, which are connected to battery leads 78, 84 in electrical parallel to battery pack 60, 62 and terminate in a second electric connector receptacle 74. This third electric cable 86 and second electric connector receptacle 74 can be used to connect another battery pack (not shown) in a second battery carrying case 40' along with the battery pack 60, 62 in the first battery carrying case 40 to the motor 30 in a daisy chain manner, if desired, to prolong the running time of the motor 30 and 12. For example, a battery pack (not shown) in the second battery carrying case 40' the same as battery pack 60, 62 daisy chained together, as shown in FIG. 7, can more than double the run time of the motor 30 and fan 12 over the run time obtainable with only battery pack 60, 62, because the rate of discharge is less for two battery packs daisy chained together than it is for one battery pack alone.

The second battery carrying case 40' is preferably outfitted with the same components as the first battery carrying case 40, and some of those same components are designated in FIG. 7 with the same numbers primed. Thus, the plug 72' on cable 70' of the second battery carrying case 40' can be plugged into either the second receptacle 74 on the first battery carrying case 40 in a daisy chained parallel connection as described above, or directly into the first receptacle 34 on the ventilator unit 10, to substitute the battery pack (not shown) in the second battery case 40' for the battery pack 60, 62 in the first battery carrying case 40 to power the motor 30 as desired.

When the battery carrying case 40 is disconnected from the ventilator unit 10, as illustrated in FIG. 2, the first plug 72 on second cable 70 can be inserted for storage into the second receptacle 74, which keeps the cable 70 and plug 72 from dangling and getting entangled with other equipment or with workers. A handle 73 attached to plug 72 helps a person to grasp and pull the plug 72 out of receptacles 34 and 74.

Figure 8:
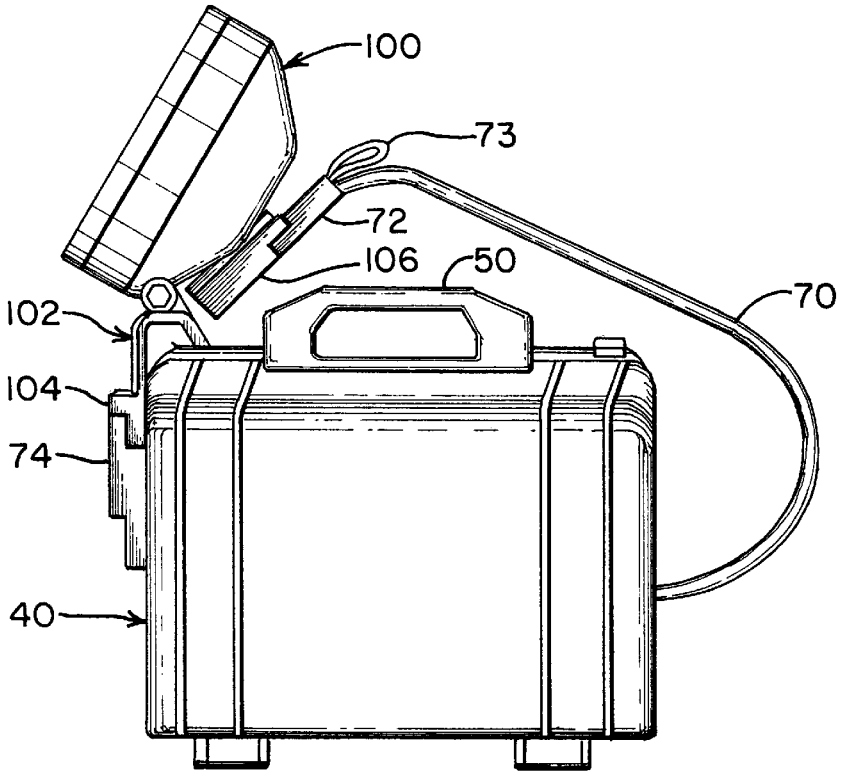
FIG. 8 is a side elevation view of the battery carrying case of the present invention assembled with an optional emergency flood light.
Figure 9:
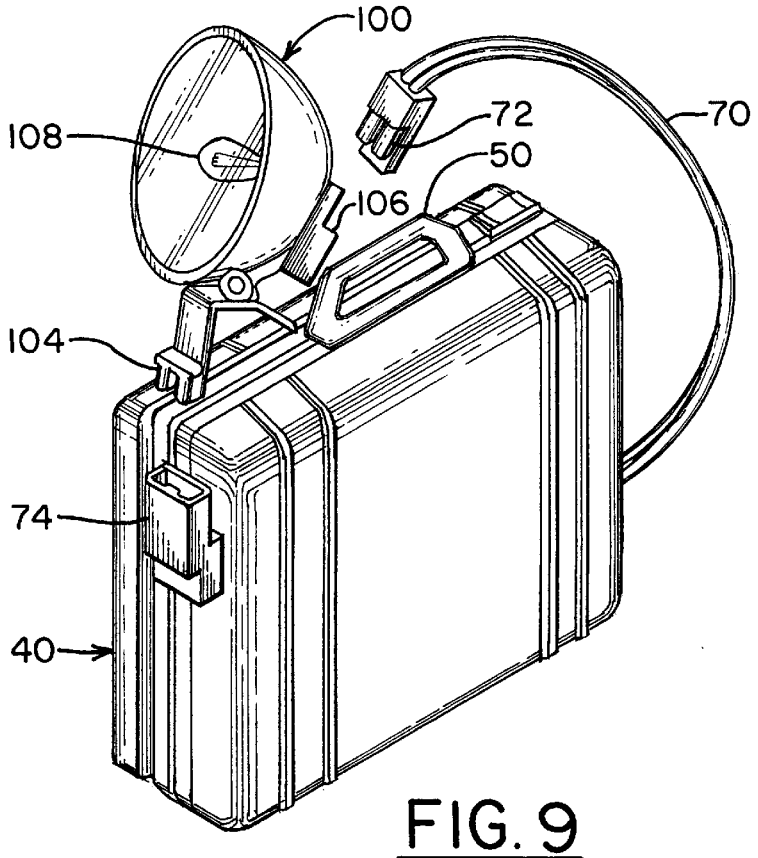
FIG. 9 is a perspective view of the optional emergency flood light positioned to be assembled with the battery carrying case of the present invention.

An optional emergency flood light attachment 100, shown in FIGS. 8 and 9, has a mounting bracket 102 with an end 104 that is configured with a size and shape that matches a plug 72 so that it is insertable into and fits snugly in the second receptacle 74. While there is no electrical connection between the receptacle 74 and bracket end 104, the receptacle 74 does provide a secure, but detachable support for the flood light 100. A third receptacle 106 mounted on the flood light 100 is electrically connected to a light generating element 108 in the flood light 100 and is sized and shaped to receive the plug 72 on cable 70 to power the light generating element 108 with the battery pack 60, 62 (not shown in FIGS. 8 and 9). Therefore, a rescue worker or firefighter can also use the battery pack 60, 62 of the battery carrying case 40 to illuminate a dark area to assist in rescue or fire fighting operations.

The foregoing description is considered as illustrative only of the principles of the invention. Furthermore, since a number modifications and changes will readily occur to those skilled in the art, it is not desired to limit the invention to the exact construction and process shown described above. Accordingly, all suitable modifications and equivalents may be resorted to falling within the scope of the invention as defined by the claims which follow.

The embodiments of the invention in which an exclusive property or privilege is claimed are defined as follows:

1. A pressure ventilator of a type carried by fire fighters and rescue workers to a burning building to provide either positive or negative pressure ventilation in the burning building, said pressure ventilator being further of a type that has a fan connected mechanically to, and driven by, an electric motor, said fan and electric motor being mounted together on a frame as a ventilator unit that includes the fan, the electric motor, and the frame and that has a first electric cable with two electric conductors, each of which electric conductors has two ends, one of said ends of each electric conductor of said first electric cable being connected electrically to the electric motor and the other end of each electric conductor of said first electric cable terminating in a first connector receptacle, said pressure ventilator being further characterized by a first battery carrying case containing a battery pack, a motor controller connected electrically to the battery pack, a second electric cable with two electric conductors, each of which electric conductors has two ends, one of said ends of each electric conductor of said second electric cable being connected electrically to the motor controller and the other end of each electric conductor of said second electric cable terminating in a first connector plug that is adapted in size and shape to mate with said first connector receptacle in a manner that provides secure, but releaseable, electrical connection between electric conductors of the second electric cable and electric conductors of the first electric cable, and an on/off switch mounted on said battery carrying case and positioned electrically between said battery pack and said first connector plug, said battery pack having sufficient battery cells to power said electric motor to drive said fan for at least twenty minutes without falling below a minimum voltage threshold and said motor controller being operative to compare battery voltage with said minimum voltage threshold and to connect the battery pack electrically to the second electric cable when the battery voltage is above said minimum voltage threshold and to disconnect the battery pack electrically from the second electric cable when the battery voltage is below said minimum voltage threshold, said first battery carrying case having a handle for convenient grasping, whereby said first battery carrying case containing said battery pack, said motor controller, and said second electric cable is stowable on a fire or rescue vehicle and carryable by fire fighters or rescue workers to a burning building separate from the ventilator unit that includes said fan, said motor, said frame, and said first electric cable, and then which the battery pack and motor controller in the battery carrying case being connectable electrically to the electric motor in the ventilator unit at the burning building to power the electric motor to drive the fan to pressurize the burning building for at least twenty minutes by connecting the first plug to the first receptacle and actuating the on/off switch to on mode.

2. The pressure ventilator of claim 1, wherein said battery carrying case includes a third electric cable with two electric conductors, each of which electric conductors has two ends, one of said ends of each electric conductor of said third electric cable being connected in electrical parallel with the battery pack and the motor controller and the other end of each electric conductor of said third electric cable terminating in a second connector receptacle that is adapted in size and shape to mate with said first connector plug, whereby said first connector plug is stowable by connection with said second connector receptacle when said first connector plug is not connected to said first connector receptacle of said ventilator unit.

3. The pressure ventilator of claim 2, including a second battery carrying case equipped and outfitted the same as the first battery carrying case, the battery pack of the second carrying case being connectable in electric parallel with the battery pack of the first battery case to the electric motor of the ventilator unit by connecting the first connector plug of the second battery carrying case to the second connector receptacle of the first battery carrying case.

4. The pressure ventilator of claim 1, wherein said ventilator unit includes a pair of wheels mounted rotatably on, and supporting, said frame, and a battery carrying case rack mounted on said frame, said battery carrying case rack being adapted in size and shape to receive and hold securely said first battery carrying case, whereby, once said first battery carrying case and said ventilator unit are removed from the fire or rescue vehicle, said first battery case is mountable in said battery carrying case rack for wheeling along with the ventilator unit to the burning building, and further whereby said first connector plug can be connected to said first connector receptacle to power the electric motor while the first battery carrying case is mounted in said battery carrying case rack, and further whereby, after the ventilator unit is lifted onto the fire or rescue vehicle, said first battery carrying case can be mounted in said battery carrying case rack for stowage together.

* * * * *